United States Patent [19]

Kasai

[11] Patent Number: 4,631,787

[45] Date of Patent: Dec. 30, 1986

[54] BUCKLE HAVING MANUALLY RELEASABLE INTERLOCKING MALE AND FEMALE PORTIONS

[75] Inventor: Kazumi Kasai, Namerikawa, Japan

[73] Assignee: Nippon Notion Koygo Co., Ltd., Tokyo, Japan

[21] Appl. No.: 753,950

[22] Filed: Jul. 11, 1985

[30] Foreign Application Priority Data

Jul. 27, 1984 [JP] Japan ..... 59-114676[U]

[51] Int. Cl.[4] ..... A44B 11/25

[52] U.S. Cl. ..... 24/616; 24/615

[58] Field of Search ..... 24/616, 615, 614, 573, 24/323, 171, 194, 116 A

[56] References Cited

U.S. PATENT DOCUMENTS

| | | | |
|---|---|---|---|
| 1,326,055 | 12/1919 | Hirsch | 24/616 |
| 1,477,597 | 12/1923 | Schneider | 24/616 |
| 1,737,246 | 11/1929 | Jones | 24/616 |
| 4,150,464 | 4/1979 | Tracy | 24/615 |
| 4,398,324 | 8/1983 | Bakker et al. | 24/615 |

FOREIGN PATENT DOCUMENTS

| | | | |
|---|---|---|---|
| 0095656 | 12/1983 | European Pat. Off. | 24/615 |
| 860867 | 1/1941 | France | 24/616 |
| 2226129 | 11/1974 | France | 24/616 |
| 2451175 | 11/1980 | France | 24/616 |
| 55-20939 | 2/1980 | Japan . | |

*Primary Examiner*—Victor N. Sakran

*Attorney, Agent, or Firm*—Hill, Van Santen, Steadman & Simpson

[57] ABSTRACT

A buckle of synthetic resin is composed of a male member and a female member which can be separated from each other and coupled to each other. The male member has an attachment for attachment to a belt or the like, and a connecting portion composed of a central base including a pair of resilient engagement portions having slanted outer surfaces from which grips extend outwardly. The female member includes an attachment and a tubular member in which the central base can be inserted. The tubular member has fingers lockingly engageable with end surfaces of the engagment portions. The engagement portions have teeth disposed respectively on the end surfaces thereof. The central base has stop pawls disposed outwardly of the teeth and extending toward the end surfaces beyond ends of the teeth.

10 Claims, 10 Drawing Figures

BUCKLE HAVING MANUALLY RELEASABLE INTERLOCKING MALE AND FEMALE PORTIONS

BACKGROUND OF THE INVENTION

1. Field of the Invention:

The present invention relates to a buckle for use with straps, belts, suspenders and similar fastening articles used independently or attached to garments, bags and the like, and more particularly to a buckle composed of a male member and a female member, the male member having grips for releasing the male member from the female member.

2. Description of the Prior Art:

Buckles generally comprise independent male and female members each integrally molded of synthetic resin. One example of such buckles is disclosed in Japanese Laid-Open Utility Model Publication No. 55-20939 published on Feb. 9, 1980. The male member of the disclosed buckle has a connecting portion composed of a central base integral with a slotted attachment for attachment to a belt or the like, two bent arms extending from the lower end of the central base toward the slotted attachment, and two engagement portions having outer sides extending obliquely from the bent arms toward the slotted attachment. The female member has a tubular portion in which the male member can be inserted. For coupling the male and female members, the connecting portion of the male member is inserted into the tubular portion of the female member to cause the engagement portions to engage the inner wall surface of the tubular portion. When the male member is to be detached from the female member, the engagement portions are manually tilted inwardly toward each other to release them out of engagement with the inner wall surface of the tubular portion. The engagement portions of the male member have grips for tilting the engagement portions.

With the prior buckle, however, the engagement portions extend from the arm toward the slotted attachment, leaving spaces between themselves and the central base, and the spaces tend to trap therein raveled threads of garments, ornamental cords, or other foreign matter. If the male member is pulled with the foreign object trapped between at least one of the engagement portions and the central base, the engagement portion would be pulled outwardly by the trapped object and finally broken.

SUMMARY OF THE INVENTION

It is an object of the present invention to provide a buckle of synthetic resin having enegagement portions which are protected against damage or breakage even when they are subjected to an outward force.

According to the present invention, there is provided a buckle of synthetic resin comprising separate male and female members which can be mated together. The male member has an attachment for attachment to a belt or the like, and a connecting portion composed of a central base including a pair of resilient engagement portions having slanted outer surfaces from which grips extend outwardly. The female member includes an attachment and a tubular member in which the central base can be inserted. The tubular member has fingers for locking engagement with end surfaces of the engagement portions. The engagement portions have teeth disposed respectively on the end surfaces thereof.

The central base has stop pawls disposed outwardly of the teeth and extending toward the end surfaces beyond ends of the teeth. When the engagement portions of the male member are pulled outwardly away from each other, the teeth thereof are brought into engagement with the stop pawls to guard against further outward displacement and hence against breakage or unwanted damage.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

Figure 9:
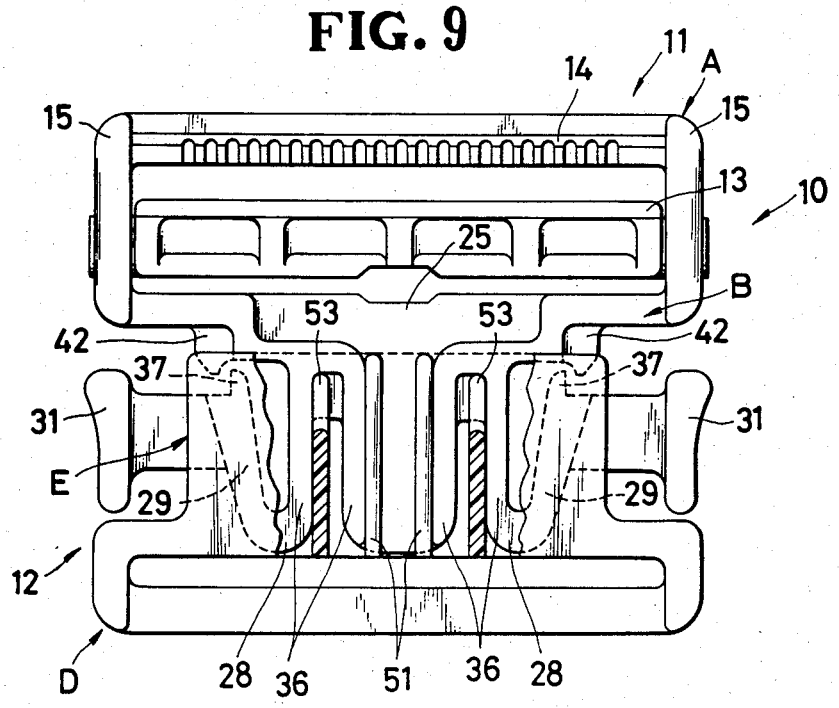
FIG. 9 is a front elevational view, partly shown in cross section, of the buckle with the male and female members coupled together.
Figure 10:
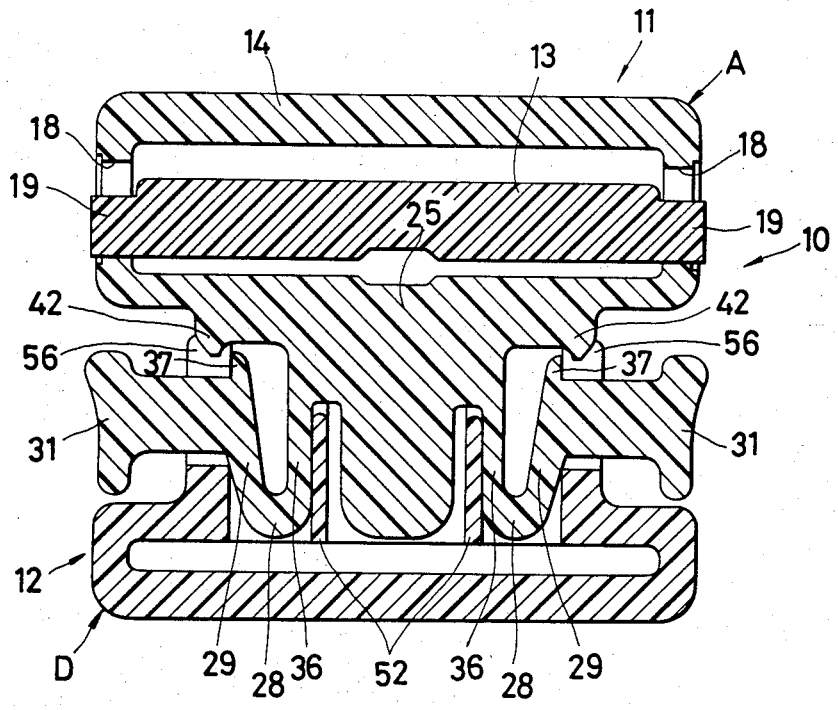
FIG. 10 is a cross-sectional view of the combined buckle.

The principles of the present invention are particularly advantageous when embodied in a buckle, generally designated by the reference numeral 10, shown in FIGS. 9 and 10.

The buckle 10 has a male member 11 integrally molded of synthetic resin, and a female member 12 also integrally molded of synthetic resin. As shown in FIGS. 1 through 5, the male member 11 is generally composed of a slotted attachment A having a belt retainer bar 13 to which a belt, strap, a suspender, or the like is attached, and a connecting portion B integral with the slotted attachment A.

Figure 1:
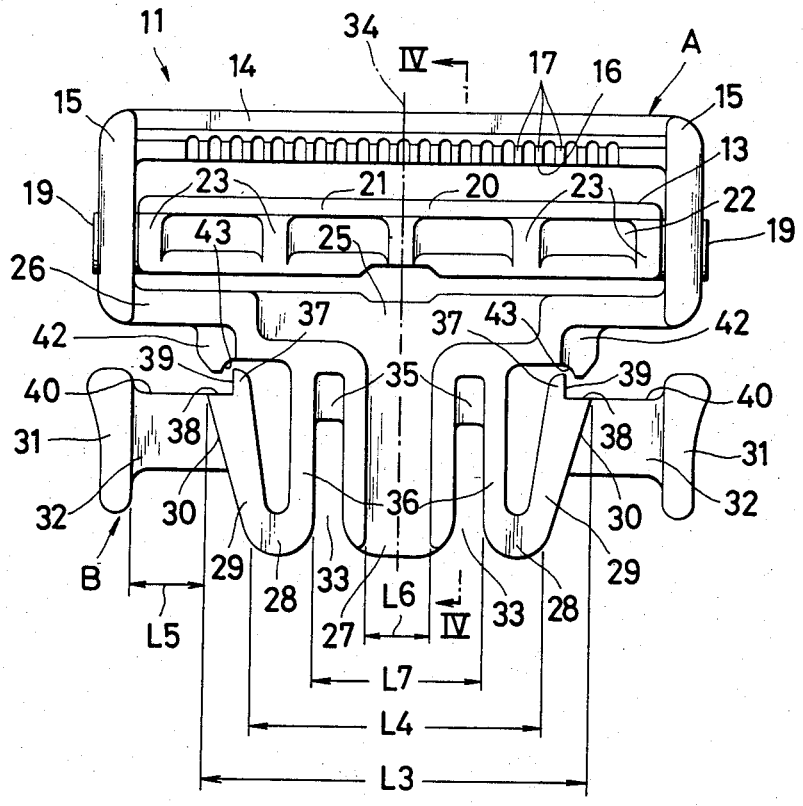
FIG. 1 is a front elevational view of a male member of a buckle according to the present invention.
Figure 2:
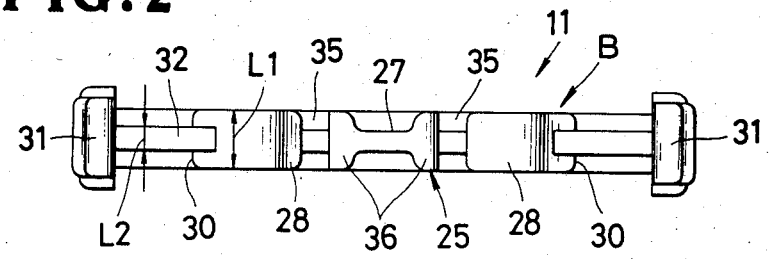
FIG. 2 is a bottom view of the male member shown in FIG. 1.
Figure 3:
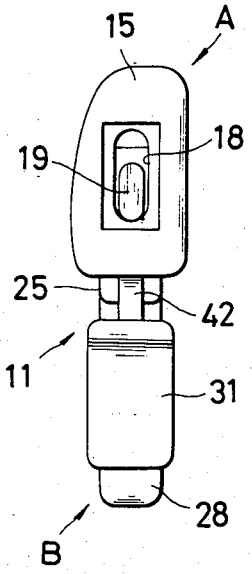
FIG. 3 is a side elevational view of the male member shown in FIG. 1.

As illustrated in FIG. 1, the slotted attachment A is of a substantially C-shaped construction comprising an elongate belt presser 14 and a pair of legs 15, 15 extending parallel to each other from the longitudinal ends of the elongate belt presser 14. The belt presser 14 is of a substantially square cross section thinner than the legs 15, 15 and has a belt bearing surface 16 confronting the belt retainer bar 13. The belt presser 14 also has a plurality of ridges 17 on each of its opposite surfaces, the ridges 17 extending parallel to the legs 15, 15 from longitudinal edges of the belt bearing surface 16 toward a substantially transversely central portion of the belt presser 14. The ridges 17 are disposed on longitudinal portions of the belt presser 14 which project transversely of the belt presser 14. As better shown in FIG.

3, each of the legs 15 has a slot 18 defined longitudinally therein, the slots 18 in the legs 15 being positioned in alignment with each other. The belt retainer bar 13 has its longitudinal ends 19 disposed respectively in the slots 18.

The belt retainer bar 13 is composed of a central member 20 extending between the ends 19 thereof, the belt retainer bar 13 being integrally molded of synthetic resin. The ends 19 are narrower and shorter than the slots 18. The central member 20 has a length slightly smaller than the distance between the inner surfaces of the legs 15, so that there are small clearances between the ends of the central member 20 and the inner surfaces of the legs 15. The central member 20 has a substantially T-shaped cross section including a portion 21 closer to the belt presser 14 and having a thickness which is substantially the same as that of the belt presser 14, but larger than that of a portion 22 of the central member 20 which is closer to the connecting portion B. The thickness of the portion 21 is greater than the width of the slots 18. The central member 20 has on its face and back a plurality of ribs 23 extending parallel to the legs 15 transversely from one edge to the other edge of the portion 22, each of the ribs 23 being of a substantially triangular cross section. The ribs 23 are positioned at the opposite longitudinal ends of the central member 20 and at spaced locations between these longitudinal ends of the central member 20.

Figure 4:
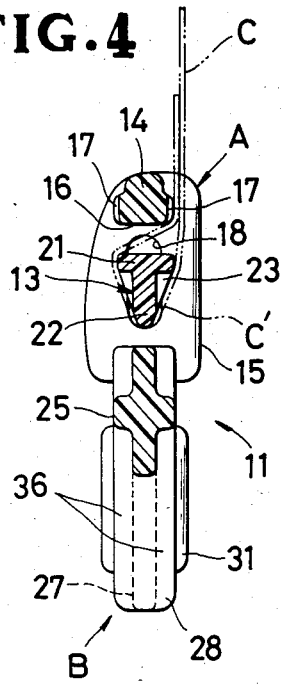
FIG. 4 is a cross-sectional view taken along line IV—IV of FIG. 1.

As shown in FIG. 4, a belt or the like C is attached to the male portion by having its end portion C' disposed around the belt retainer bar 13 and held against the belt presser 14, as indicated by the two-dot-and-dash lines in FIG. 4. When the belt C as thus attached is pulled with respect to the male member 11, the belt retainer bar 13 is displaced toward the belt presser 14 to press the belt end portion C' against the belt bearing surface 16.

The connecting portion B has a central base 25 of a substantially T-shaped configuration including a connecting base 26 integrally joined to the legs 15 remotely from the belt presser 14, and a tongue 27 extending from a longitudinally central portion of the connecting base 26 away from the slotted attachment A. The connecting portion B also includes a pair of bent arms 28, 28 extending laterally in opposite directions from sides of the central base 25, and a pair of engagement portions 29, 29 integral with the bent arms 28, 28, respectively, and having outer side surfaces 30, 30 extending obliquely from the bent arms 28, 28 toward the legs 15, 15, respectively. A pair of grips 31, 31 is integrally joined to the outer surfaces of the engagement portions 29, 29, respectively, through thinner coupling legs 32, 32.

The central base 25 has a pair of recesses 33, 33 defined in its lower (as shown in FIG. 1) end thereof and symmetrically positioned with respect to the central axis 34 of the male member 11. The central base 25 also has grooves 35 defined in its face and back and contiguous to the recesses 33, the grooves 35 extending parallel to the central axis 34. The tongue 27 extends parallel to the central axis 34, i.e., the direction in which the male member 11 is inserted into the female member, from the upper end to lower end (as shown in FIG. 1) of the central base 25. The tongue 27 includes an upper portion extending along the connecting base 26 toward the legs 15, 15 of the slotted attachment A. The central base 25 has raised marginal edges 36 defining the recesses 33, the grooves 35, and the tongue 27.

The engagement portions 29 have on their upper ends (as shown in FIG. 1) teeth 37 projecting from upper surfaces 38 thereof toward the slotted attachment A, each of the teeth 37 having an outer side surface 39 extending perpendicularly to the upper surface 38. The upper surfaces 38 lie flush with the upper surfaces 40 of the coupling legs 32, 32, respectively.

The connecting base 26 has on its lower surface (as shown in FIG. 1) a pair of stop pawls 42, 42 disposed outwardly of the teeth 37 and extending toward the engagement portions 29 in confronting relation to the teeth 37. Each of the stop pawls 42 has an inner side surface 43 extending substantially parallel to the outer side surface 39 of the corresponding tooth 37.

Figure 5:
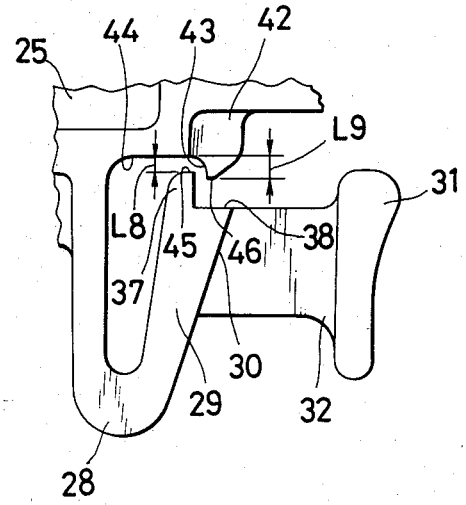
FIG. 5 is an enlarged front elevational view of a portion of FIG. 1.

As illustrated in FIG. 5, the central base 25 has a lower surface 44 spaced a distance L8 from an upper end 45 of the tooth 37, the distance L8 being smaller than the distance L9 between the lower surface 44 of the central base 25 and a lower surface 46 of the stop pawl 42. When the engagement portions 29 are turned outwardly, the teeth 37 will therefore abut against the stop pawls 42 preventing further turning movement of the engagement portions 29. Therefore, the stop pawls 42 extend downwardly (as shown in FIGS. 1 and 5) beyond the upper surfaces 45 of the teeth 37.

The bent arms 28, the engagement portions 29, the grips 31, the raised edges 36, and the teeth 37 have substantially the same thickness as that of the portion 21 of the belt retainer bar 13. The coupling legs 32, the grooved portions 35, the tongue 27, and the stop pawls 42 have substantially the same thickness as that of portion 22 of the belt retainer bar 13.

Figure 6:
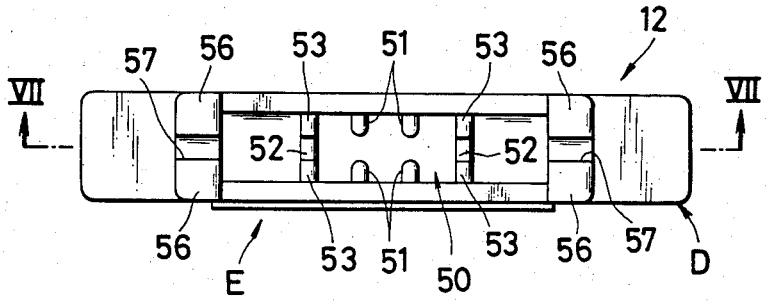
FIG. 6 is an end elevational view of a female member of the buckle.
Figure 7:
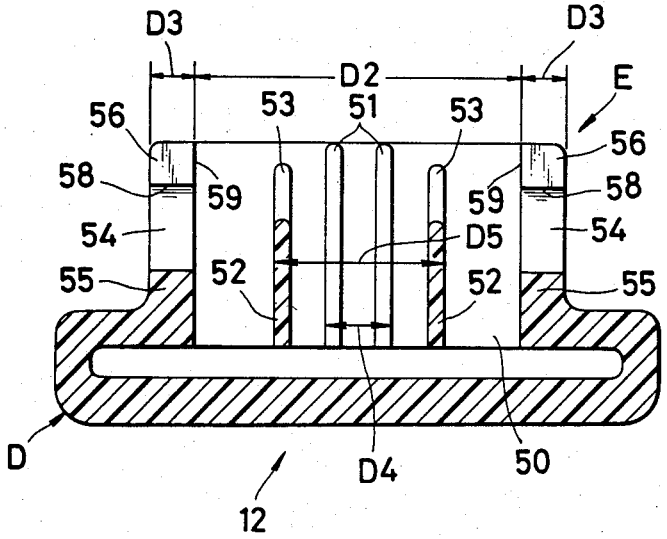
FIG. 7 is a cross-sectional view taken along line VII—VII of FIG. 6.
Figure 8:
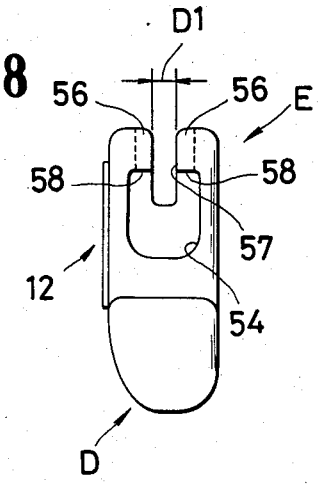
FIG. 8 is a side elevational view of the female member shown in FIG. 6.

FIGS. 6 through 8 show the female member 12, which is generally composed of a slotted attachment D to which a belt or the like is attached, and a tubular member E integral therewith. The tubular member E comprises a hollow portion 50 in which the central base 25, the bent arms 28, and the engagement portions 29 will be fitted. Two pairs of ridges 51 are disposed on confronting inner surfaces of the hollow portion 50 for engagement with the tongue 27 parallel to the central axis 34 of the male member 11 when the connecting porton B thereof is inserted into the hollow portion 50. The hollow portion 50 also has two spaced walls 52 integral with the inner surfaces thereof for insertion into the recesses 33, respectively, in the central base 25 of the male member 11, and two pairs of ridges 53 integral with the inner surfaces of the hollow portion 50 for engagement respectively in the grooves 35 in the central base 25.

The tubular member E has recesses 54 defined in side walls 55 thereof and opening upwardly (as shown in FIG. 7). The side walls 55 each have on their upper portions a pair of confronting fingers 56 projecting into the recesses 54. Therefore, the recesses 54 have openings 57 constricted by the fingers 56. The fingers 56 have lower surfaces 58 for engagement with the upper surfaces 38 of the engagement portions 29 of the male member 11, and inner surfaces 59 for engagement with the outer surfaces 39 of the teeth 37 of the male member 11.

The confronting surfaces of the fingers 56 are spaced from each other by a distance D1, equal to the width of the openings 57, smaller than the thickness L1 of the engagement portions 29 of the male member 11, and larger than the thickness L2 of the coupling legs 32 and the stop pawls 42. The side walls 55 of the hollow portion 50 are spaced from each other by a distance D2, equal to the width of the hollow portion 50, smaller than the free distance L3 between the upper outer ends of the engagement portions 29 of the male member 11, and larger than the distance L4 between lower outer ends of the engagement portions 29. Each of the side walls 55 has a width D3 smaller than the minimum distance L5 between the engagement portion 29 and the grip 31. The outer surfaces of the ridges 51 are spaced from each other by a distance D4 which is substantially the same as or slightly smaller than the distance L6 between the inner surfaces of the raised edges 36 which define the tongue 27 therebetween. The outer surfaces of the walls 52 and the ridges 53 are spaced from each other by a distance D5 which is substantially the same as or slightly smaller than the distance L7 between the inner surfaces of the outer raised edges 36 which define the recesses 33.

When the male member 11 is inserted into the female member 12, the inner surfaces 59 of the fingers 56 are first brought into contact with the slanted outer surfaces 30 of the engagement portions 29 since the distance D2 is smaller than the distance L3. Then, the engagement portions 29 are resiliently pressed toward the central base 25 about the bent arms 28 while the coupling legs 32 pass between the fingers 56 or through the constricted openings 57 of the recesses 54. When the lower surfaces 58 of the fingers 56 are positioned upwardly of the upper surfaces 38 of the engagement portions 29, the inner surfaces 59 of the fingers 56 are disengaged from the outer slantd surfaces 30 of the engagement portions 29, whereupon the engagement portions 29 spring back under the resiliency of the bent arms 28, as shown in FIGS. 9 and 10.

Since the width D2 is smaller than the distance L3, the upper surfaces 38 of the engagement portions 29 are held in locking engagement with the lower surfaces 58 of the fingers 56. Therefore, the male member 11 and the female member 12 are locked together as shown in FIGS. 9 and 10.

The outer surfaces 38 of the engagement portions 29 are positioned outwardly of the bent arms 29. When the male and female members 11, 12 are subjected to a pulling force tending to pull them apart for tilting the engagement portions 29 outwardly, the outer surfaces 39 of the teeth 37 will be held against the inner surfaces 59 of the fingers 46 to guard against further outward tilting movement of the engagement portions 29. If the teeth 37 were not present, the engagement portions 29 would be tilted outwardly until their upper ends would project from the recesses 54, and would finally be broken in the vicinity of the bent arms 28.

With the male and female members 11, 12 held in locked engagement with each other, the inner surfaces of the raised edges 36 lying along the tongue 27 are held against the outer surfaces of the ridges 51, and the inner surfaces of the raised edges 36 outward of the recesses 33 are held against the outer surfaces of the walls 52 and the ridges 53. Therefore, the male and female members 11, 12 are securely coupled together without wobbling movement with respect to each other.

For detaching the male member 11 from the female member 12, the grips 31 projecting out of the side walls 55 of the female member 12 are pressed resiliently as by the thumb and index finger of a user's hand until the engagement portions 29 are pressed against the central base 25. Now, the upper surfaces 38 of the engagement portions 29 are laterally displaced clear of engagement with the lower surfaces 58 of the fingers 56. Since the coupling legs 32 are then positioned in alignment with the openings 57, the male member 11 can be removed from the female member 12 simply by pulling the male member 11 away from the female member 12.

When the engagement portions 29 are displaced outwardly under undue forces applied while the male member 11 is detached from the female member 12, the teeth 37 are brought into engagement with the stop pawls 42 to prevent the engagement portions 29 from being further displaced outwardly and hence from being broken or otherwise damaged.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A buckle comprising:

(a) a male member of synthetic resin composed of a rectangular attachment for being attached to a fastening article, and a connecting portion secured to said attachment, said connecting portion comprising:

(1) a central base integral with said attachment along the length thereof;

(2) a pair of U-shaped resilient arms extending integrally from an intermediate portion of said central base with free ends extending toward the ends of said central base;

(3) a pair of engagement portions integral with said resilient bent arms, respectively, and having outwardly facing slanted surfaces, respectively; and (4) a pair of grips joined to said engagement portions, respectively, and extending away from each other;

(b) a female member of synthetic resin composed of an attachment for being attached to a fastening article, and a tubular member integral with said attachment, said tubular member having a hollow portion for reception of said connecting portion therein, and fingers projecting perpendicularly to the plane of said U-shaped arms for locking engagement with end surfaces of said engagement portions, respectively; and (c) each of said engagement portions having a tooth projecting from said end surface thereof toward said base, said central base having a pair of stop pawls disposed outwardly of said teeth and extending toward said end surfaces and beyond ends of said teeth.

2. A buckle according to claim 1, said central base having an elongate connecting base joined to said attachment and a tongue extending from a central portion of said connecting base.

3. A buckle according to claim 1, said teeth having outer surfaces lying in confronting relation to said stop pawls, respectively, for engagement therewith.

4. A buckle according to claim 3, said fingers having inner surfaces, respectively, for locking engagement with said outer surfaces of said teeth when said central base has been inserted in said hollow portion.

5. A buckle according to claim 1, said hollow portion having a pair of opposite side walls having recesses defined respectively therein, said fingers projecting toward each other into each of said recesses and defining a constricted opening therebetween.

6. A buckle according to claim 5, said central base including coupling legs by which said grips are joined to said engagement portions, respectively, said coupling legs being movable through said openings when said central base is inserted into said hollow portion.

7. A buckle according to claim 1, said hollow portion including first ridges for engagement with said tongue when said central base is inserted in said hollow portion.

8. A buckle according to claim 7, said central base having raised edges bounding said tongue therebetween, said first ridges of said hollow portion being firmly engageable with said raised edges.

9. A buckle according to claim 1, said central base having a pair of spaced recesses and grooves contiguous to said recesses, said hollow portion including a pair of spaced walls and second ridges, said walls and said second ridges being positionable in said recesses and said grooves, respectively, when said central base is inserted in said hollow portion.

10. A buckle according to claim 9, said central base having raised edges bounding said recesses and said grooves, said walls and said second ridges of said hollow portion being firmly engageable with said raised edges.

* * * * *